US007140209B2

(12) United States Patent
Lai

(10) Patent No.: US 7,140,209 B2
(45) Date of Patent: Nov. 28, 2006

(54) PADLOCK WITH FULLY INTEGRATED DUAL LOCKING SYSTEMS

(75) Inventor: Eric Lai, Sheung Shui (HK)

(73) Assignee: The Sun Lock Co. Ltd., Hong Kong (HK)

( * ) Notice: Subject to any disclaimer, the term of this patent is extended or adjusted under 35 U.S.C. 154(b) by 54 days.

(21) Appl. No.: 10/850,838

(22) Filed: May 21, 2004

(65) Prior Publication Data

US 2005/0092036 A1 May 5, 2005

Related U.S. Application Data

(60) Provisional application No. 60/517,006, filed on Nov. 4, 2003.

(51) Int. Cl.
*E05B 37/10* (2006.01)

(52) U.S. Cl. ..... 70/25; 70/21; 70/319; 70/284

(58) Field of Classification Search ..... 70/20–21, 70/31, 35–49, 25, 22, 28
See application file for complete search history.

(56) References Cited

U.S. PATENT DOCUMENTS 952,291 A * 3/1910 O'Leary ..... 100/228
1,993,408 A * 3/1935 Ledin ..... 70/38 B
4,351,171 A * 9/1982 Tsui ..... 70/339
4,733,548 A * 3/1988 Ling ..... 70/25
6,176,109 B1 * 1/2001 Tsui ..... 70/25
6,792,778 B1 * 9/2004 Chen ..... 70/21
6,860,125 B1 * 3/2005 Yu ..... 70/25
6,904,776 B1 * 6/2005 Lin ..... 70/25
2002/0088256 A1 * 7/2002 Taylor et al. ..... 70/25
2005/0034492 A1 * 2/2005 Yu ..... 70/25
2005/0044900 A1 * 3/2005 Yu ..... 70/25
2005/0044901 A1 * 3/2005 Yu ..... 70/25
2005/0044902 A1 * 3/2005 Yu ..... 70/25

* cited by examiner

*Primary Examiner*—Brian E. Glessner
*Assistant Examiner*—William Schrode
(74) *Attorney, Agent, or Firm*—Melvin I. Stoltz

(57) ABSTRACT

By providing two separate and independent locking systems formed in a single padlock, with both locking systems independently enabling the single shackle to be released and/or lockingly engaged, an effective, easily produced, multi-purpose padlock is achieved. In the preferred embodiment, a single housing and shackle assembly are employed and constructed for enabling the shackle to be released from locked engagement with the housing using either a rotatable dial combination construction or a key activating tumbler construction. In this way, a dual locking and releasing padlock is achieved which virtually eliminates the difficulties typically encountered with known, prior art lock configurations.

14 Claims, 7 Drawing Sheets

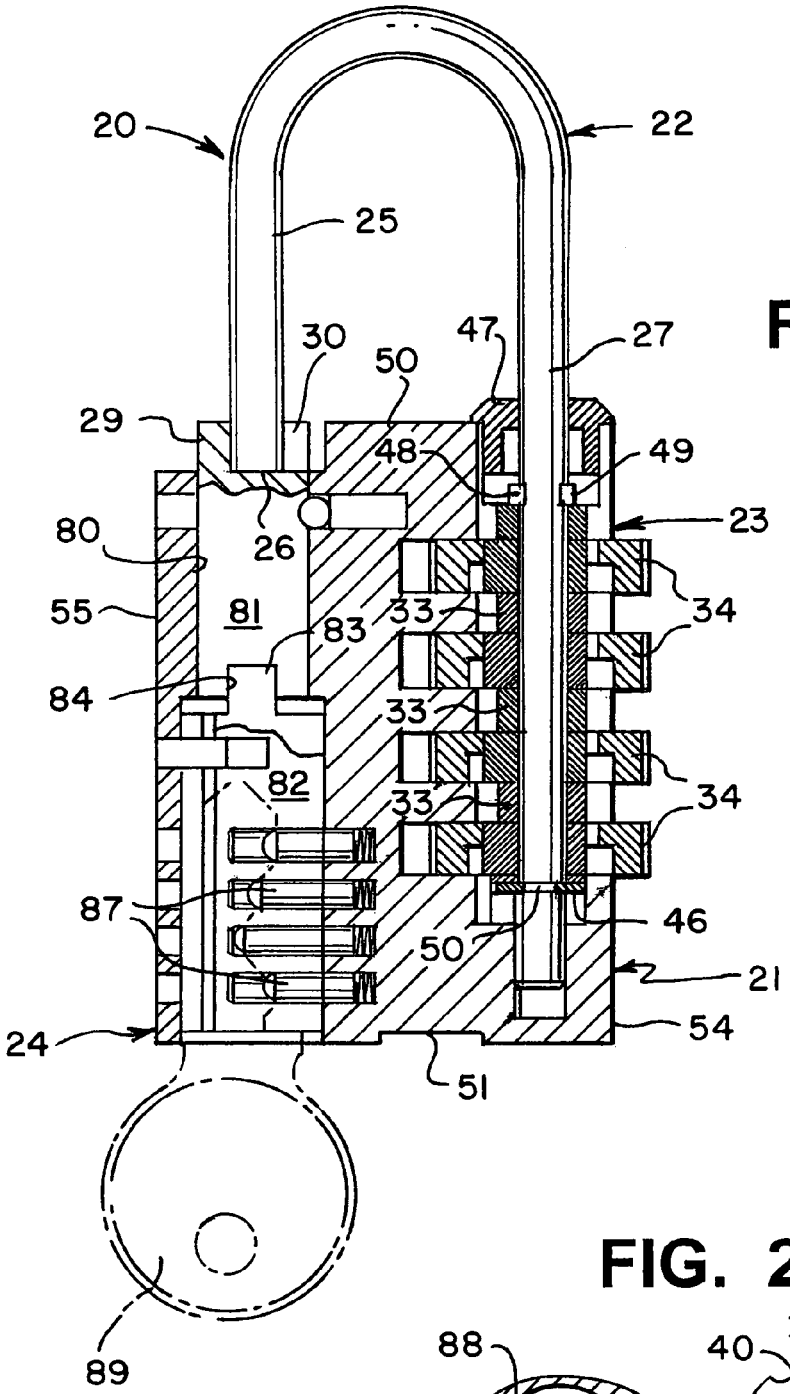
FIG. 1
FIG. 2
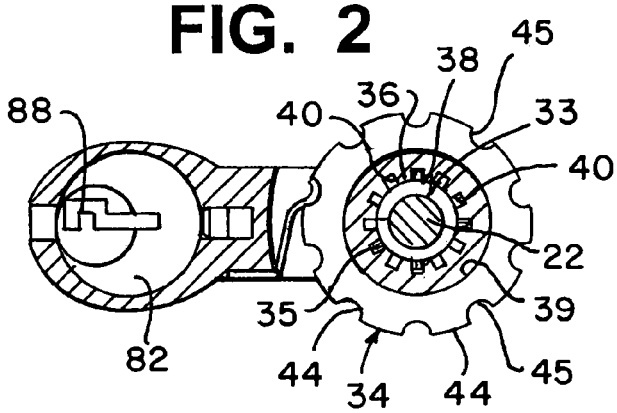

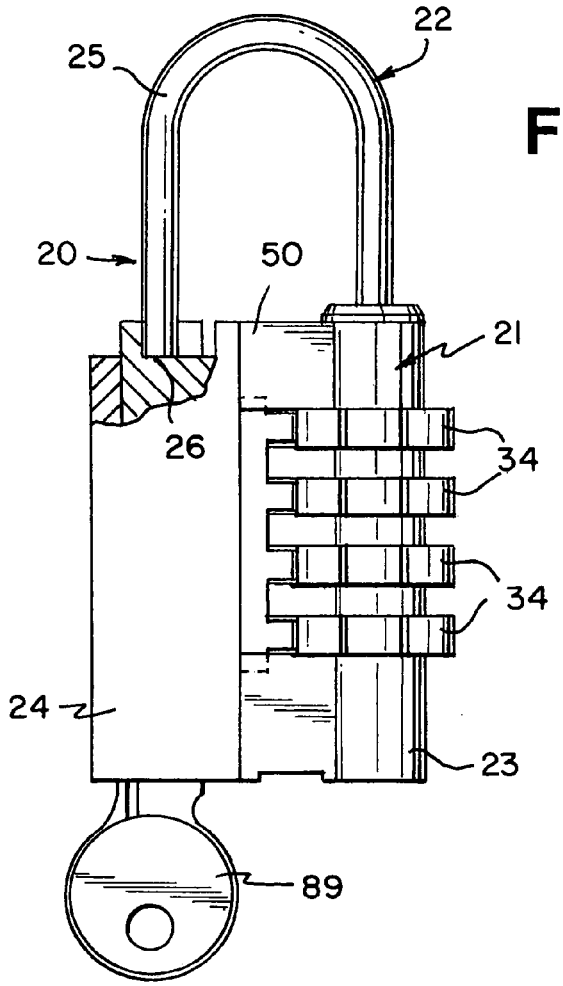
FIG. 3
FIG. 4
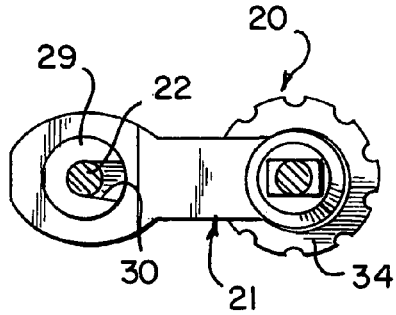
FIG. 7
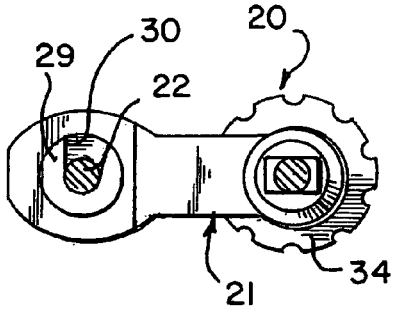
FIG. 9
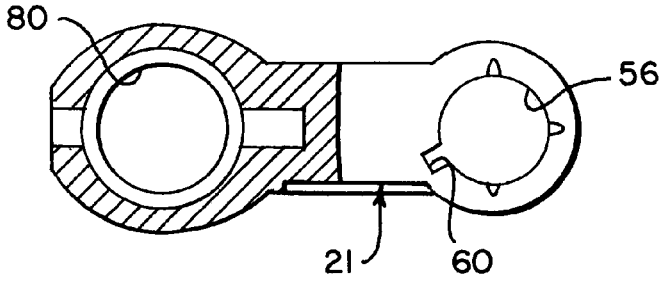

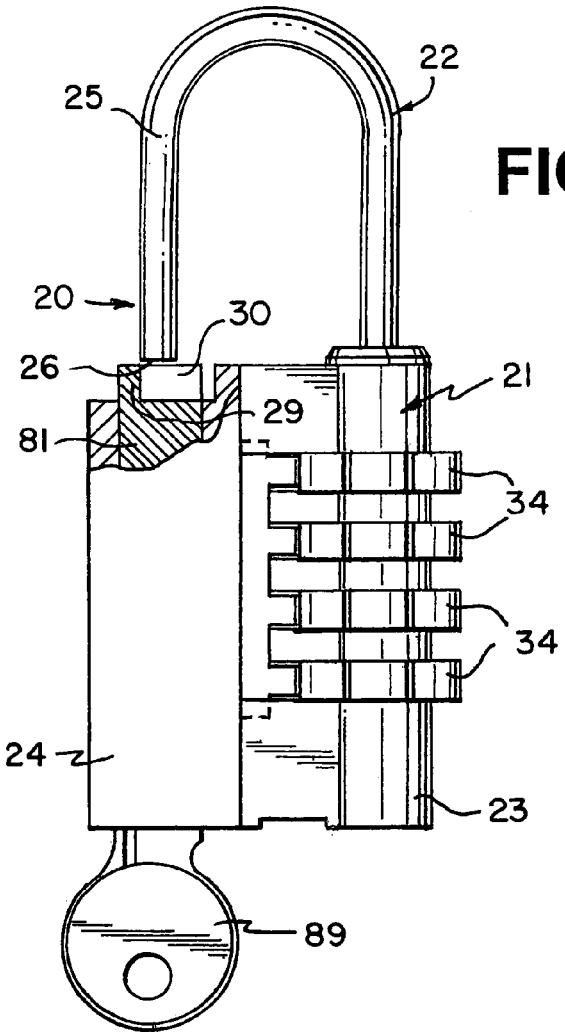
FIG. 5
FIG. 6
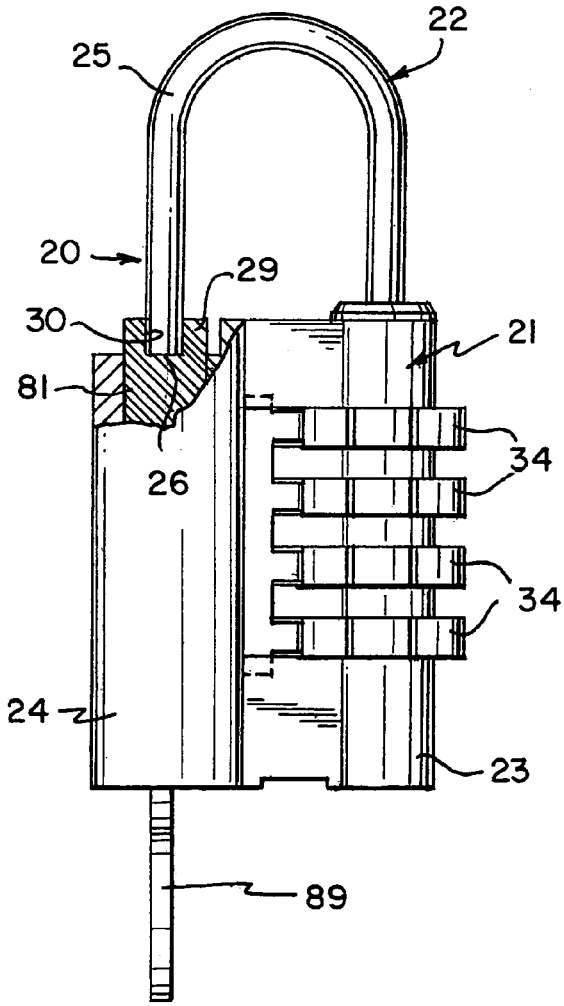

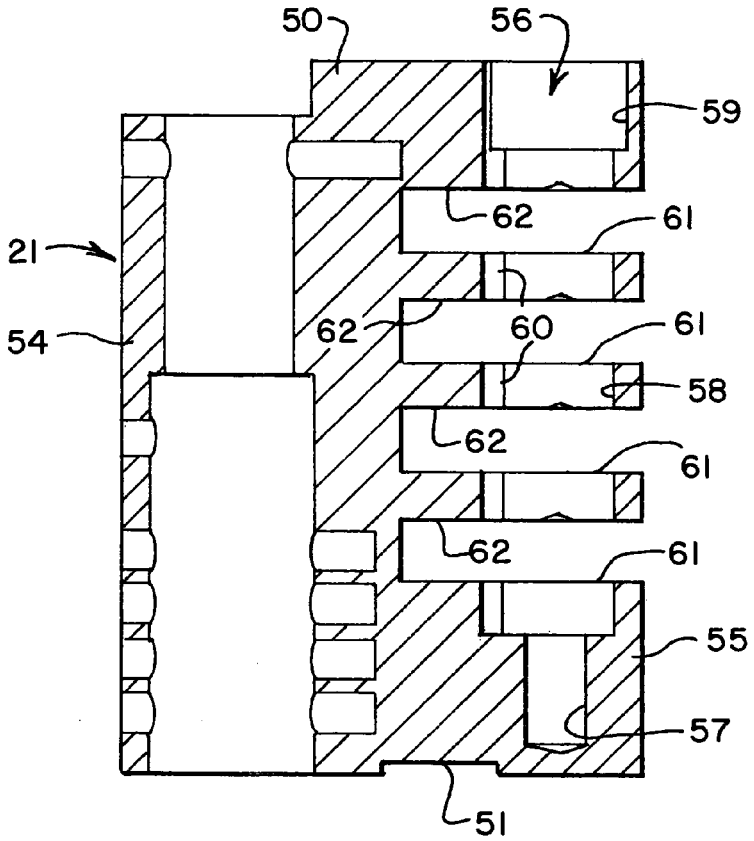
FIG. 8
FIG. 10
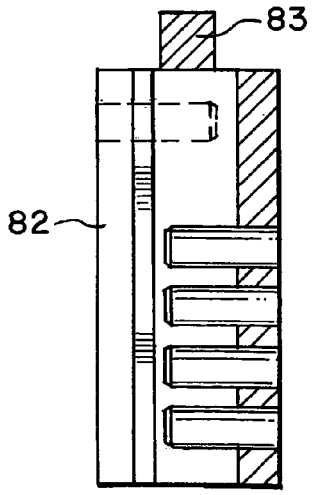
FIG. 11
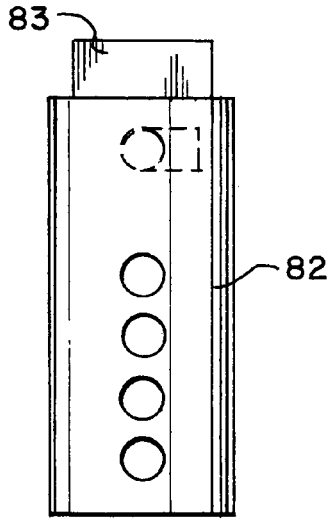

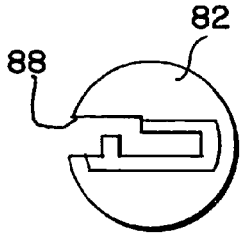
FIG. 12
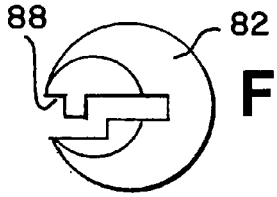
FIG. 13
FIG. 14
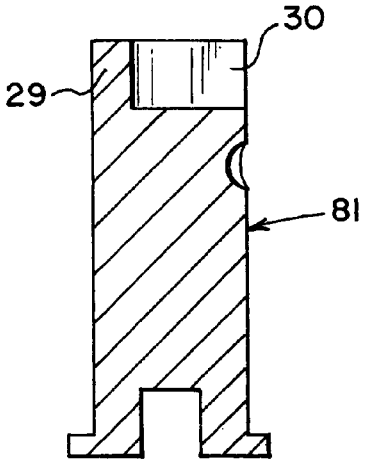
FIG. 15
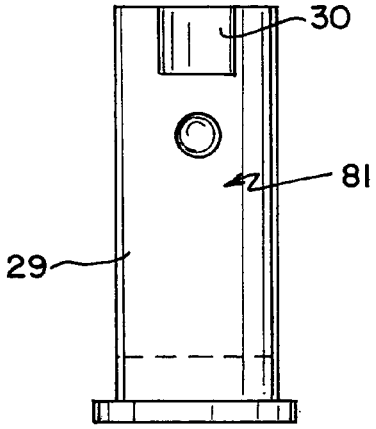
FIG. 16
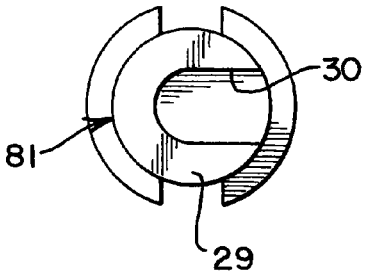
FIG. 17
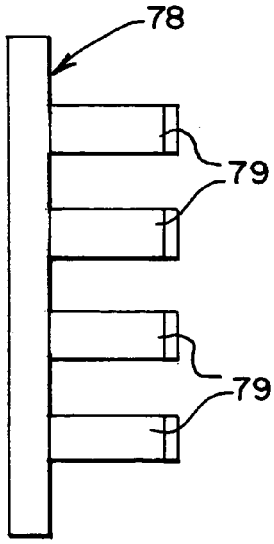
FIG. 18
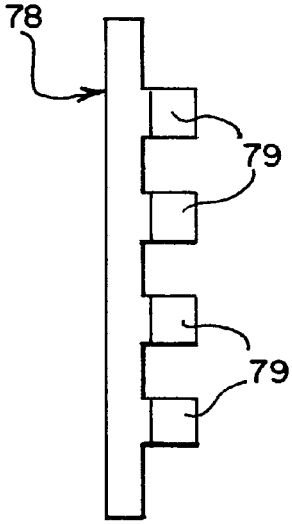
FIG. 19
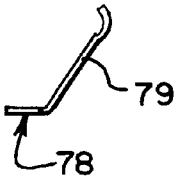

PADLOCK WITH FULLY INTEGRATED DUAL LOCKING SYSTEMS

RELATED APPLICATIONS

This application is related to U.S. Provisional Patent Application Ser. No. 60/517,006, filed Nov. 2, 2003 entitled PADLOCK WITH DUAL LOCKING MODES.

TECHNICAL FIELD

This invention relates to padlocks and lock systems and, more particularly, to padlocks constructed to provide two separate an independent modes by which the padlock can be opened and closed.

BACKGROUND ART

Numerous padlock constructions have been developed and are widely employed by individuals to prevent unauthorized persons from gaining access to any particular item or area which has been closed and locked. Although many locks are constructed to be opened by a key, numerous combination lock constructions have been developed which are opened by knowledge of a particular combination.

One particular type of combination lock that has become very popular due to its ease and convenience of use is a combination lock which employs a plurality of rotatable independent dials, each of which forms one of the indicia, usually numerals or letters, which comprise the combination for releasing the lock. Typically, the combination lock has one mode or position in which the user is able to set or reset the desired combination sequence. Although locks of this general nature have been available for several decades, these prior art combination lock constructions suffer from common deficiencies which have not been successfully overcome.

Although many manufacturers have attempted to solve the problems associated with rotatable dial or combination locks, one principal difficulty and drawback these prior art constructions have been unable to overcome is a construction which assures the user that a preset combination will not be accidentally or inadvertently altered or changed, without the user's knowledge. In such instances when the known combination is unknowingly changed or altered without the user's knowledge, the entire combination lock is incapable of future use, since the user is typically unable to release the shackle from locked engagement with the housing.

In addition, although key operated locks do not suffer from the difficulty of having the combination changed or altered without the user's knowledge, users are frequently incapable of using key operated locks, due to the key being lost or misplaced. As a result, prior art key operated locks are also frequently discarded due to the user's inability to find a particular key for operating the lock.

Another common problem which has consistently plagued prior art constructions is the cost of construction for producing and assembling prior art padlocks, whether the padlock is key operated or combination operated. In order to attain a padlock which provides all of the features desired by consumers, prior art constructions typically incorporate numerous small components, each of which require expensive assembly procedures to produce the final product. As a result, these prior art lock constructions are expensive to produce, thereby reducing the ability of these locks to reach a broad base of consumers.

Another problem commonly found with prior art padlocks is the inability of these prior art constructions to prevent contaminants from reaching the rotatable, internal component of the lock, thereby causing damage to these components or interfering with the ease of operating the lock by an individual who either knows the actual combination or has the activating key. Although numerous attempts have been made to reduce the adverse effects caused by contaminants reaching these components, such attempts have been incapable of completely eliminating in this problem.

A final, still further difficulty, which has recently arisen and affects both combination locks and key operated locks, is a requirement that all secured locks must be broken by Customs officers, and/or inspection or security personnel in order to gain access to luggage which is deemed suspicious. Under new security regulations that is being implemented, all luggage must be scanned or inspected to prevent the transportation of potentially dangerous items or products which are deemed to be undesirable. In those instances when luggage is scanned and further visual inspection is required, the inspectors have the authority to open the luggage for visual inspection, including physically breaking any lock which may be on the luggage.

Consequently, with these new regulations presently implemented, all prior art lock systems which are incapable of being opened by inspectors and/or security personnel are subject to be physically broken, in order to gain access to any luggage which needs to be visually inspected. As a result, consumers will now be faced with the possibility that any lock system employed to protect the contents of a suitcase can be physically removed by security personnel, leaving the luggage completely unprotected during the remainder of the trip.

SUMMARY OF THE INVENTION

By employing the present invention, all of the difficulties and drawbacks of the prior art constructions are virtually eliminated and an effective, easily produced, padlock is achieved which incorporates two separate and independent locking systems formed in a single padlock, with both locking systems independently enabling the single shackle to be released and/or lockingly engaged. In this way, by using the key activating feature, a user is assured of the ability to release the shackle from locked engagement whenever the combination is forgotten, altered or changed without the user's knowledge. Similarly, whenever the key is lost or misplaced, the user is still able to release the shackle from locked engagement with the housing by employing the known combination.

In accordance with the present invention, a single housing and shackle assembly are employed and constructed for enabling the shackle to be released from locked engagement with the housing using either a rotatable dial combination construction or a key activating tumbler construction. In this way, a dual locking and releasing padlock is achieved which virtually eliminates the difficulties typically encountered with known, prior art lock configurations.

In each of the two preferred embodiments of the present invention, a generally conventional J-shaped shackle is employed with one portion of the housing cooperatively associated with the longer leg of the shackle. In addition, this portion of the housing is also constructed with rotatable, combination defining dials which control the axial movement of the longer leg of the shackle. In this way, axial movement of the shackle in the housing is completely controlled by the rotatable, combination defining dials, enabling the locking and releasing of the shackle relative to the housing by employing the known combination.

Directly adjacent the combination lock portion of the housing is the key activating portion of the housing. This portion is constructed for lockingly engaging and releasing the short leg of the shackle. By incorporating into the housing a tumbler and rotatable chamber lock assembly, which is responsive to the cuts on a key for positioning the tumblers to be properly aligned for enabling the chamber to be rotatable, controlled movement of a shackle engaging cavity is achieved, which either lockingly engages the shackle to the housing or releases the shackle for rotatable movement relative to the housing.

By employing the dual locking mode system of the present invention, all of the difficulties and drawbacks found in prior art constructions are overcome. In the present invention, the user is capable of employing either of two separate and independent shackle controlling locking systems for releasing the shackle from locked engagement with the housing whenever release is desired. As a result, if the control system for one of the locking modes is not available, the second mode can be employed for completely operating the padlock in the desired manner.

In addition, by employing the dual locking constructions of the present invention, all of the difficulties and drawbacks which travelers face under newly enacted regulations are completely overcome. As detailed above, recently enacted regulations empower Customs officers, and/or inspection and security personnel to physically break any secured lock on a suitcase in order to gain access to a suitcase which is a believed to contain suspicious material. However, by employing the present invention, the possibility of having one's lock completely broken by Customs or security personnel is totally prevented.

By employing the dual locking mode padlocks of the present invention, which comprises a combination controlled section and key controlled section, a Master Key is created which is able to open the key controlled section of all dual mode padlocks. As a result, in the event that a Customs officer or security personnel require a particular piece of luggage to be opened for further visual inspection, the Customs officer or security personnel is able to open the dual locking mode padlocks by employing the Master Key, which is provided to all such individuals. In this way, physically breaking a lock is totally eliminated and, once visual inspection has been completed, the dual locking mode padlocks would be replaced on the luggage and locked in position, in order to assure that the contents remains secure throughout the remainder of the trip.

Furthermore, the padlocks of the present invention are constructed with the interior chambers virtually sealed from the ambient surroundings, thereby preventing unwanted contamination from entering the interior of the padlock and the rotating component thereof. In this way, prior art degradation and interference of the lock operation by contamination is virtually eliminated.

In addition, in accordance with the present invention, a minimum number of components are employed in combination with the housing and the movable shackle, in order to provide the desired unique, dual mode padlock constructions of the present invention. In addition to the shackle and housing, only the plurality of rotating dials, plurality of tumblers sleeves, key operated tumblers and rotatable chamber are required to provide the dual mode padlock constructions of this invention.

In addition to the features detailed above, the present invention achieves a dual mode padlock using a minimum number of independent components, each of which is capable of being quickly assembled into the final product. As a result, a construction is attained which is capable of being manufactured at a competitive price, while providing a high quality, highly effective dual mode padlock which virtually eliminates any degradation due to exposure to environmental contamination.

The invention accordingly comprises an article of manufacture assessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which:

FIG. 1 is a cross-sectional, side elevation view of one embodiment of the dual mode padlock of the present invention;

FIG. 2 is a cross-sectional bottom plan view of the dual-mode padlock of the present invention taken along line 2—2 of FIG. 1;

FIG. 3 is a side elevation view of the dual-mode padlock of FIG. 1 shown in its locked position;

FIG. 4 is a top plan review taken along that line 4—4 of FIG. 3;

FIG. 5 is a side elevation view, partially in cross-section, of the dual mode padlock of FIG. 1 shown with the shackle released by the combination controlled locking section thereof;

FIG. 6 is a side elevation view, partially in cross-section, of the dual-mode padlock FIG. 1 shown with the shackle released by the key controlled the locking section thereof;

FIG. 7 is a top plan view, partially in cross-section, taken along line 7—7 of FIG. 6;

FIG. 8 is a cross-sectional side elevation view of the housing forming one principal component of the dual-mode padlock of FIG. 1;

FIG. 9 is a cross-sectional bottom view of the housing of the dual-mode padlock of the present invention taken along the line 9—9 of FIG. 8;

FIG. 10 is a side elevation view, partially in cross-section, of one cylinder forming a component of the dual mode padlock of FIG. 1;

FIG. 11 is an end view of the cylinder of FIG. 10;

FIG. 12 and FIG. 13 are bottom views of the cylinder of FIG. 10;

FIG. 14 is a cross-sectional side elevation view of a second cylinder forming a component of the dual-mode padlock of FIG. 1;

FIG. 15 is an end view of the cylinder of FIG. 14;

FIG. 16 is a top plan view of the cylinder of FIG. 14;

FIG. 17 is a side elevation view of the spring plate forming a component of the dual-mode padlock of FIG. 1;

FIG. 18 is an end view of the spring plate of FIG. 17;

FIG. 19 is a top plan view of the spring plate of FIG. 17;

DETAILED DISCLOSURE

Figure 20:
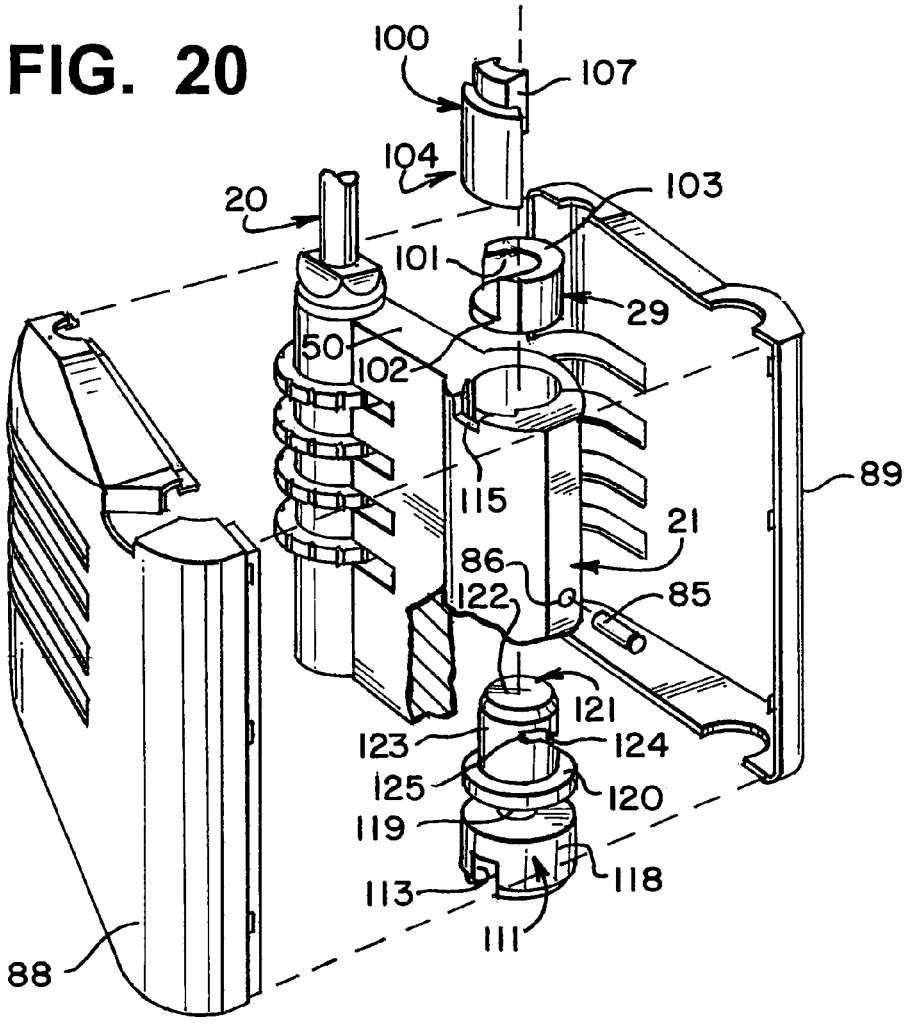
FIG. 20 is an exploded perspective view, partially broken away, of a second embodiment of the dual-mode padlock fo the present invention.
Figure 21:
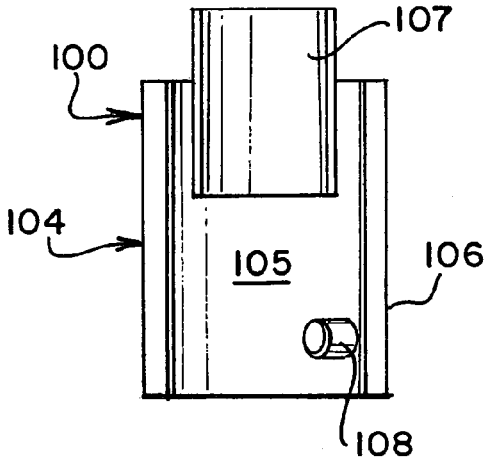
FIG. 21 is a side elevation view of a movable plate member forming a component of the dual mode padlock of FIG. 20.
Figure 22:
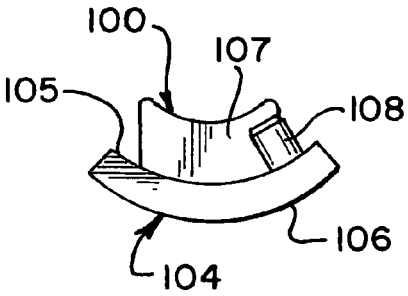
FIG. 22 is a bottom plan view of the movable plate member of FIG. 21.
Figure 23:
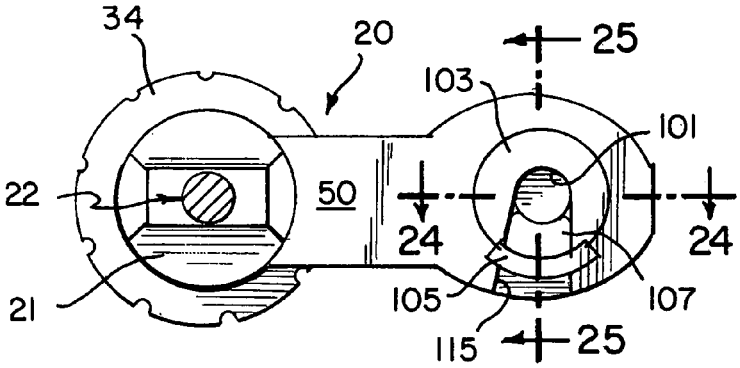
FIG. 23 is a top plan view of the dual mode padlock of FIG. 20.

By referring to FIGS. 1–26, along with the following detailed discussion, the construction and operation of two alternate embodiments of dual mode padlock 20 of the present invention can best be understood. In the drawings and in the following detailed disclosure, the preferred two, alternate embodiment of the present invention are fully disclosed. However, this disclosure is provided for exemplary purposes only and, since the present invention can be implemented using further alternate constructions, it is intended that these alternate constructions are within the scope of the present invention.

In FIGS. 1–19, one preferred embodiment of dual mode padlock 20 of the present invention is depicted using a minimum of principal components, thereby achieving a dual mode padlock, while also substantially reducing the complexity found in most prior art padlocks. In this way, the present invention provides a highly effective, commercially desirable construction which is capable of being produced at a competitive cost, while also providing the unique attributes of the present invention and all of the locking and theft deterrent features typically incorporated in prior art padlocks.

In this embodiment of the present invention, the two principal components which form the dual mode padlock 20 comprise central housing 21 and shackle 22, with central housing 21 incorporating combination controlled locking section 23 formed on one side thereof and key controlled locking section 24 formed on the opposed side thereof. The components required for forming and operating combination controlled locking section 23, as well as the components required for forming and operating key controlled locking section 24 are all detailed below. However, regardless of the section used by an individual to lock and unlock padlock 20 of the present invention, the cooperative engagement of shackle 22 with housing 21 is employed.

In this preferred embodiment, shackle 22 comprises a conventional J-shape incorporating short leg 25 which has a terminating end 26, and long leg 27 having terminating end portion or section 28. As is fully detailed below, shackle 22 is in its locked and fully engaged position when a major portion of long leg 27 is contained within housing 21 and terminating end 26 of short leg 25 is engaged within locking collar 29. Furthermore, in order for dual mode padlock 22 to be unlocked or open, terminating end 26 of short leg 25 must be released or disengaged from locking collar 29.

As detailed below, the disengagement or release of short leg 25 from locking collar 29 is accomplished by activating one of the two locking sections formed in housing 21. By employing combination controlled locking section 23, and properly inputting the correct preset combination, the long leg 27 of shackle 22 is released and is able to move longitudinally or axially relative to housing 21. This longitudinal or axial movement enables terminating end 26 of short leg 25 to be axially removed from locking collar 29 resulting in the opening of dual mode padlock 20, as shown in FIG. 5.

Alternatively, by employing key controlled locking section 23, locking collar 29 is able to be arcuately pivoted, preferably through an angular distance of about 90°, positioning slot 30 formed in locking collar 29 to a location which allows shackle 22 to be arcuately pivotable relative to housing 21, enabling terminating end 26 of short leg 25 to be moved out of engagement within locking collar 29, as shown in FIGS. 6 and 7. In this way, shackle 22 is released from locked engagement with collar 29, enabling the removal of padlock 20 from the items to which it had been secured or, alternatively, enabling items to be securely engaged therewith.

In order to enable combination controlled locking section 23 of housing 21 to control the axial or longitudinal movement of long leg 27 of shackle 22, combination controlled locking section 23 incorporates four separate and independent tumbler sleeves 33 and four separate and independent rotatable dials 34. By employing these components, along with housing 21 and shackle 22, an easily produced, highly effective combination controlled locking section is realized.

Each tumbler sleeve 33 comprises a generally cylindrical shape incorporating a single locking fin 35 radially extending from outer, circular-shaped surface 36. In addition, each tumbler sleeve 33 also comprises an inside, circular-shaped surface 37 which is coaxially aligned with outside surface 36. The diameter of inside surface 37 of tumbler sleeve 33 is constructed to enable each tumbler sleeve 33 to freely pivot about the outer surface of shackle 22.

Each dial 34 is constructed for peripherally surrounding and cooperating with a tumbler sleeve 33. In this regard, each dial 34 comprises two separate and distinct, circular-shaped inside surfaces 38 and 39. Side surface 38 comprises a diameter slightly greater than the diameter of outside surface 36 of tumbler sleeve 33, in order to enable tumbler sleeve 33 and dial 34 to cooperate with each other while being independently rotationally movable about 22.

In addition, each dial 34 comprises a plurality of slots 40 formed in inside surface 38, with each slot being constructed for receiving and retaining radially extending fin 35 of tumbler sleeve 33. In this way, whenever radially extending fin 35 is mounted in a slot 40 of dial 34, tumbler sleeve 33 and dial 34 are in interlocked engagement, causing both members to rotate together about shackle 22.

The number of slots 40 formed in dial 34 corresponds to the number of separate and distinct indicia formed on the outer surface of dial 34. In the preferred embodiment, ten indicia are employed on the outside surface of dial 34 and ten slots 40 are formed in surface 38.

Inside surface 39 of dial 34 comprises a circular shape formed by a diameter which is aligned with the axis of surface 38, but is greater than the length of fin 35. In this way, when fin 35 is disengaged from slot 40 of dial 34, dial 34 is able to rotate about shackle 22 independently of tumbler sleeve 33. Each tumbler sleeve 33 is rotationally mounted to leg 27 of shackle 22, with each tumbler sleeve having a dial 34 rotationally associated therewith.

As discussed above, each dial 34 has a plurality of indicia formed on the outer peripheral surface thereof, each of which represents one component of the combination for positioning tumbler sleeves 33 in the requisite location for releasing shackle 22. Although any desired indicia can be employed, numerals or letters are typically employed on prior art constructions. In the present invention, each dial 34 comprises an outer surface 44 on which ten panels 45 are formed with slots 46 separating each panel 45. In addition, one numeral ranging from 0, 1, 2, 3, 4, 5, 6, 7, 8 and 9 is formed on each panel 45. The numeral in each panel 45 of each dial 24 is then employed to define the combination for padlock 20.

The remaining components employed to form combination controlled locking section 23 of housing 21 of padlock 20 comprise split locking ring 46 and sealing cap 47. In the preferred construction, leg 27 of shackle 22 incorporates ribs 48 and 49 formed on the outer surface thereof and a locking ring receiving slot 50 formed directly adjacent terminating end section 28 of leg 27 of shackle 22.

As clearly depicted in FIG. 1, the axial distance between ribs 48 and 49 and slot 50 is constructed for being substantially equivalent to the axial length required for enabling locking ring 46, when mounted in slot 50, to retain the four tumbler sleeves 33 on leg 27 of shackle 22, with each tumbler sleeves 33 being capable of independent rotational movement, while substantially eliminating any axial movement thereof. In this way, tumbler sleeves 33 are able to provide the desired locking and unlocking function, while achieving this result in an easily manufactured and easily assembled construction.

Preferably, a visual indicator of the proper orientation for each numeral or letter of each panel 45 of each dial 34 is also provided by incorporating on housing 21 a position orientating line. This line enables the user to visually position each numeral in the proper location for a pre-set combination.

As shown in the drawings, housing 21 comprises a single piece construction, within which various cavities, bores, and receiving zones are formed for enabling the dual, independent, locking systems to operate. In general, housing 21 comprises a top surface 50, a bottom surface 51, a front panel 52, a rear panel 53, and two side panels 54 and 55.

In addition, combination controlled locking section 23 of housing 21 incorporates a central, elongated bore 56 which extends through section 23 from top surface 50 to bottom surface 51. In this regard, bore 56 comprises portal 68, formed with top surface 50. In addition, bore 56 comprises three separate diameters, forming three separate and independent coaxial zones 57, 58, and 59. Zone 57 comprises the lowermost zone of bore 56, and comprises a diameter slightly greater than the diameter of shackle 22. In this way, terminating end section 28 of leg 27 of shackle 22 is capable of axial movement in zone 57, while also preventing any other components mounted to leg 33 of shackle 22 from entering zone 57.

Zone 58 comprises the intermediate zone of bore 56 and has a diameter slightly greater than the outside diameter of tumbler sleeves 33. In this way, tumbler sleeves 33 are capable of axial movement through zone 58 of central bore 56. In addition, zone 58 also comprises an elongated slot or channel 60 formed along one wall of zone 58, providing the release position for each radially extending fin 35 of each tumbler sleeve 33. As is more fully detailed below, when each locking fin of each tumbler sleeve 33 is aligned with release channel 60, shackle 22 is capable of axial movement, thereby enabling shackle 22 to be removed from its locked position or, if desired, inserted into its locked position, or axially advanced into zone 57 of bore 56 of housing 21, to enable the combination to be changed, set or re-set.

The final zone of bore 56 is upper zone 59 which comprises the largest diameter of bore 56. Generally, the diameter of zone 59 is constructed to enable each tumbler sleeve 33 with its radially extending fin 35 to be easily advanced through first portal 68 of zone 59. In this way, assembly of combination section 23 of padlock 20 is easily attained.

In addition, upper zone 59 and its associated first portal zone 68 are constructed for receiving and securely retaining sealing cap 47. In its preferred construction, sealing cap 47 comprises a cylindrical shape formed by outer surface 70 and upper flange 71. Preferably, the diameter of zone 59 is substantially equivalent to the diameter of outer surface 70 of cap 47 in order to require cap 37 to be forced into first portal 68 and zone 59 and, once inserted therein, securely affixed thereto.

In the preferred construction, tumbler sleeves 34 and locking ring 46 are mounted to leg 27 of shackle 22. Then, when dials 34 are mounted in place, the fully assembled leg 27 of shackle 22 is inserted into first portal 68 of bore 56 of housing 21. The assembly is then completed by forcing sealing cap 47 into first portal 68 of zone 59 of bore 56 until the entire outer surface 70 of cap 47 is fully engaged in zone 59 and peripheral flange 71 contacts top surface 50.

With sealing cap 47 securely, integrally fastened to housing 21, tumbler sleeves 34 are protected from interference from environmental debris. Since bore 56 is effectively sealed from the ambient surroundings, the entry of unwanted dirt and/or debris into bore 56 is effectively prevented. As a result, long-term, trouble-free operation of padlock 20 is provided.

In order to assure that each dial 34 is cooperatively associated with a tumbler sleeve 33 and is rotatable about leg 27 of shackle 22 along with its associated tumbler sleeve, combination controlled locking section 23 of housing 21 incorporates four separate and independent dial receiving zones 61. Each dial receiving zone 61 is formed in juxtaposed spaced aligned parallel relationship with each other, while also being cooperatively associated with zone 58 of central bore 56 and elongated release channel 60. In addition, each dial receiving zone 61 is defined by an upper surface 62 and a lower surface 63 which are parallel to each other. Furthermore, each dial receiving zone 61 may be cooperatively associated with spring plate 78 which incorporates flexible arms 79. By employing spring plate 78, arms 79 are positioned for interengagement with dial 34, in order to prevent unwanted rotation of dials 34. In this way, physical movement of dials 34 by the user is required to rotate dials 34. In FIGS. 17–19, the preferred construction of spring plate 78 is depicted.

Whenever a user wishes to set or change the particular combination for operating combination controlled locking section 23 of dual-mode padlock 20, the user is able to quickly and easily alter the particular combination as desired. In order to achieve this change, the user opens padlock 20, using the known combination, and then accurately pivots shackle 22 about the axis of leg 27. Thereafter, by longitudinally advancing leg 27 downwardly into elongated bore 56 of housing 21, fins 35 of tumblers 33 are all disengaged from slots 40 of dials 34.

Once dials 34 are all disengaged from tumblers 33, dials 34 can be arcuately rotated into any desired position. By individually rotating each dial 34 into a particular desired position, a unique or personalized code or sequence is created. Once each dial has been placed into the precisely desired position or alignment, shackle 22 is axially moved upwardly, bringing the locking fins 35 of each tumbler 33 into engagement in one slot 40 of one dial 34. Once these steps have been completed, the precisely desired new combination or code is established.

In addition to enabling padlock 20 to be opened by employing combination controlled locking section 23 of housing 21, dual mode padlock 20 of the present invention also incorporates key controlled locking section 24 formed as a part of housing 21 for enabling padlock 20 to be unlocked in a separate and independent alternate manner. By referring to FIGS. 1–19, along with the following detailed discussion, the construction and operation of this key controlled locking and unlocking mode of padlock 20 can best be understood.

In the preferred construction of the present invention, key controlled locking section 24 of housing 21 incorporates elongated bore 80 extending from top surface 50 through to bottom surface 51. As depicted, elongated bore 80 extends substantially parallel to elongated bore 56 formed in combination controlled locking section 23. In addition, in order to provide the desired key controlled arcuate pivoting movement of locking collar 29, for enabling shackle 22 to be securely locked and released, when desired, key controlled locking section 24 incorporates cooperating cylinders 81 and 82.

Cylinders 81 and 82 are each rotationally journalled in elongated bore 80 and are mounted in controlled engagement with each other. If desired, a single elongated cylinder may be employed. However, it has been found for ease of construction, the use of two separate cylinders is preferred. In order to assure that cylinders 81 and 82 are arcuately pivoted simultaneously, effectively functioning as a single elongated cylinder, cylinder 81 incorporates channel 83 formed in the bottom surface thereof, while cylinder 82 incorporates an upstanding flange or ridge 84 formed in its top section. By lockingly engaging flange/ridge 84 in channel 83, cylinders 81 and 82 are arcuately pivoted simultaneously.

As discussed above, key controlled locking section 24 incorporates locking collar 29 which is constructed for controlled engagement with terminating end 26 of short leg 25 of shackle 22. In the preferred construction, locking collar 29 is formed with a substantially U-shape as an integral component of cylinder 81, thereby assuring that the arcuate pivoting movement of locking collar 29 occurs simultaneously with the arcuate pivoting movement of cylinders 81 and 82.

In the preferred construction, cylinder 82 incorporates key receiving slot 88 formed in the base thereof which is constructed for cooperating controlled relationship with key 89. Furthermore, cylinder 82 incorporates a plurality of spring biased tumblers 87 which are constructed for cooperating with cut-out zones formed on key 89.

In this construction, tumblers 87 prevent the arcuate movement of cylinder 82 unless all tumblers 87 are positioned in a precise, predetermined alignment and/or arrangement. When in the desired aligned position, cylinder 82 is capable of being arcuately rotated.

In addition, in order to achieve the precisely desired aligned position for enabling cylinder 82 to be arcuately rotated, key 89 is employed for axially positioning each tumbler 87 in the precisely desired, predetermined position. In addition, key 89 provides the necessary leverage for enabling cylinder 82 to be arcuately pivoted.

Once key 89 is inserted into slot 88 of cylinder 82, tumblers 87 are aligned in the precisely desired predetermined position, enabling cylinder 82 to be arcuately rotated. In addition, since flange 84 of cylinder 82 is engaged within channel or slot 83 of tumbler 82, the arcuate pivoting movement of the cylinder 82 simultaneously causes cylinder 81 to arcuately pivot therewith. Furthermore, with locking collar 29 formed as an integral component of cylinder 81, the arcuate pivoting movement of cylinder 81 causes locking collar 29 to also pivot.

In this way, terminating end 26 of short leg 25 of shackle 22 is released from locked engagement with collar 29. As detailed above, U-shaped locking collar 29 incorporates slot or portal 30, which is normally positioned inwardly, generally facing housing 21 and preventing shackle 22 from being arcuately pivoted about its longitudinal axis. However, when locking collar 29 is arcuately pivoted about 90°, in response to the arcuate pivoting movement of cylinders 81 and 82, slot/portal 30 faces outwardly towards the side surface of housing 21, enabling terminating end 26 of leg 25 of shackle 22 to be arcuately pivoted out of engagement with locking collar 29, thereby releasing shackle 22 from locked engagement therein. In this way, the second separate and independent locking mode for padlock 20 is easily activated, in complete control by the user.

In order to prevent cylinders 81 and 82 from moving axially, once mounted in elongated bore 80, a holding pin 82 is mounted in housing 21 and engaged within slotted opening 86 formed in cylinder 82. In this way, cylinder 82 is freely pivotal about its central axis, while being incapable of axial movement in bore 80 of housing 21.

In FIGS. 20–26, a second preferred embodiment of dual mode padlock 20 of the present invention is depicted. In this embodiment, a minimum of principal components is also employed, thereby achieving a dual mode padlock, while also substantially reducing the complexity found in most prior art padlocks. In this way, the present invention provides a highly effective, commercially desirable construction which is capable of being produced at a competitive cost, while also providing the unique attributes of the present invention and all of the locking and theft deterrent features typically incorporated in prior art padlocks.

In this embodiment of the present invention, the two principal components which form the dual mode padlock 20 comprise central housing 21 and shackle 22, with central housing 21 incorporating combination controlled locking section 23 formed on one side thereof and key controlled locking section 24 formed on the opposed side thereof. The components required for forming and operating combination controlled locking section 23, as well as the components required for forming and operating key controlled locking section 24 are all detailed below. However, regardless of the section used by an individual to lock and unlock padlock 20 of the present invention, the cooperative engagement of shackle 22 with housing 21 is employed.

In this preferred embodiment, shackle 22 comprises a conventional J-shape incorporating short leg 25 which has a terminating end 26, and long leg 27 having terminating end portion or section 28. As is fully detailed below, shackle 22 is in its locked and fully engaged position when a major portion of long leg 27 is contained within housing 21 and terminating end 26 of short leg 25 is engaged within locking collar 29. Furthermore, in order for dual mode padlock 22 to be unlocked or open, terminating end 26 of short leg 25 must be released or disengaged from locking collar 29.

As detailed below, the disengagement or release of short leg 25 from locking collar 29 is accomplished by activating one of the two locking sections formed in housing 21. By employing combination controlled locking section 23, and properly inputting the correct preset combination, the long leg 27 of shackle 22 is released and is able to move longitudinally or axially relative to housing 21. This longitudinal or axial movement enables terminating end 26 of short leg 25 to be axially removed from locking collar 29 resulting in the opening of dual mode padlock 20, as shown in FIG. 5.

Figure 26:
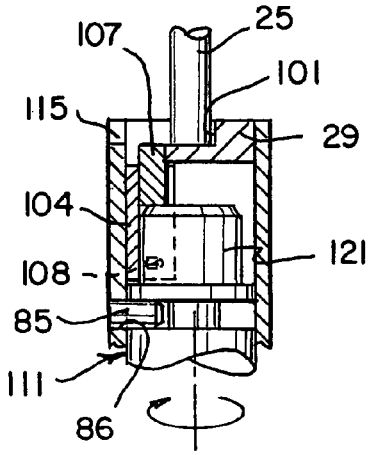
FIG. 26 is a cross-sectional side elevation view, partially broken away, depicting this embodiment of the dual mode padlock in its unlocked configuration.

Alternatively, by employing key controlled locking section 23 in this embodiment, wall member 100 of locking collar 29 is moved vertically, relative to housing 21, effectively forming portal or open zone 101 in collar 29 which allows shackle 22 to be arcuately pivotable relative to housing 21, enabling terminating end 26 of short leg 25 to be moved out of engagement within locking collar 29, as shown in FIG. 26. In this way, shackle 22 is released from locked engagement with collar 29, enabling the removal of padlock 20 from the items to which it had been secured or, alternatively, enabling items to be securely engaged therewith.

In order to enable combination controlled locking section 23 of housing 21 to control the axial or longitudinal movement of long leg 27 of shackle 22, combination controlled locking section 23 of this embodiment of the present invention is constructed in a manner substantially identical to the embodiment detailed above. As a result, by referring to the following detailed disclosure along with FIGS. 20–25 and FIGS. 1–19, the construction and operation of this embodiment can be fully understood. In this regard, combination controlled locking section 23 incorporates four separate and independent tumbler sleeves 33 and four separate and independent rotatable dials 34. By employing these components, along with housing 21 and shackle 22, an easily produced, highly effective combination controlled locking section is realized.

As described above, each tumbler sleeve 33 comprises a generally cylindrical shape incorporating a single locking fin 35 radially extending from outer, circular-shaped surface 36. In addition, each tumbler sleeve 33 also comprises an inside, circular-shaped surface 37 which is coaxially aligned with outside surface 36. The diameter of inside surface 37 of tumbler sleeve 33 is constructed to enable each tumbler sleeve 33 to freely pivot about the outer surface of shackle 22.

Each dial 34 is constructed for peripherally surrounding and cooperating with a tumbler sleeve 33. In this regard, each dial 34 comprises two separate and distinct, circular-shaped inside surfaces 38 and 39. Side surface 38 comprises a diameter slightly greater than the diameter of outside surface 36 of tumbler sleeve 33, in order to enable tumbler sleeve 33 and dial 34 to cooperate with each other while being independently rotationally movable about 22.

In addition, each dial 34 comprises a plurality of slots 40 formed in inside surface 38, with each slot being constructed for receiving and retaining radially extending fin 35 of tumbler sleeve 33. In this way, whenever radially extending fin 35 is mounted in a slot 40 of dial 34, tumbler sleeve 33 and dial 34 are in interlocked engagement, causing both members to rotate together about shackle 22.

The number of slots 40 formed in dial 34 corresponds to the number of separate and distinct indicia formed on the outer surface of dial 34. In the preferred embodiment, ten indicia are employed on the outside surface of dial 34 and ten slots 40 are formed in surface 38.

Inside surface 39 of dial 34 comprises a circular shape formed by a diameter which is aligned with the axis of surface 38, but is greater than the length of fin 35. In this way, when fin 35 is disengaged from slot 40 of dial 34, dial 34 is able to rotate about shackle 22 independently of tumbler sleeve 33. Each tumbler sleeve 33 is rotationally mounted to leg 27 of shackle 22, with each tumbler sleeve having a dial 34 rotationally associated therewith.

As discussed above, each dial 34 has a plurality of indicia formed on the outer peripheral surface thereof, each of which represents one component of the combination for positioning tumbler sleeves 33 in the requisite location for releasing shackle 22. Although any desired indicia can be employed, numerals or letters are typically employed on prior art constructions. In the present invention, each dial 34 comprises an outer surface 44 on which ten panels 45 are formed with slots 46 separating each panel 45. In addition, one numeral ranging from 0, 1, 2, 3, 4, 5, 6, 7, 8 and 9 is formed on each panel 45. The numeral in each panel 45 of each dial 24 is then employed to define the combination for padlock 20.

The remaining components employed to form combination controlled locking section 23 of housing 21 of padlock 20 comprise split locking ring 46 and sealing cap 47. In the preferred construction, leg 27 of shackle 22 incorporates ribs 48 and 49 formed on the outer surface thereof and a locking ring receiving slot 50 formed directly adjacent terminating end section 28 of leg 27 of shackle 22.

As clearly depicted, the axial distance between ribs 48 and 49 and slot 50 is constructed for being substantially equivalent to the axial length required for enabling locking ring 46, when mounted in slot 50, to retain the four tumbler sleeves 33 on leg 27 of shackle 22, with each tumbler sleeves 33 being capable of independent rotational movement, while substantially eliminating any axial movement thereof. In this way, tumbler sleeves 33 are able to provide the desired locking and unlocking function, while achieving this result in an easily manufactured and easily assembled construction.

Preferably, a visual indicator of the proper orientation for each numeral or letter of each panel 45 of each dial 34 is also provided by incorporating on housing 21 a position orientating line. This line enables the user to visually position each numeral in the proper location for a pre-set combination.

As shown in the drawings, housing 21 comprises a single piece construction, within which various cavities, bores, and receiving zones are formed for enabling the dual, independent, locking systems to operate. In general, housing 21 comprises a top surface 50, a bottom surface 51, a front panel 52, a rear panel 53, and two side panels 54 and 55. In addition, as shown in FIG. 20, cover panels 98 and 99 are mounted to housing 21 for peripherally surrounding and enveloping housing 21. In this way, any desired outer surface configuration, color, visual appearance etc. can be attained for providing a desired aesthetic appeal and/or providing added protection to the surface of the housing.

In addition, combination controlled locking section 23 of housing 21 incorporates a central, elongated bore 56 which extends through section 23 from top surface 50 to bottom surface 51. In this regard, bore 56 comprises portal 68, formed with top surface 50. In addition, bore 56 comprises three separate diameters, forming three separate and independent coaxial zones 57, 58, and 59. Zone 57 comprises the lowermost zone of bore 56, and comprises a diameter slightly greater than the diameter of shackle 22. In this way, terminating end section 28 of leg 27 of shackle 22 is capable of axial movement in zone 57, while also preventing any other components mounted to leg 33 of shackle 22 from entering zone 57.

Zone 58 comprises the intermediate zone of bore 56 and has a diameter slightly greater than the outside diameter of tumbler sleeves 33. In this way, tumbler sleeves 33 are capable of axial movement through zone 58 of central bore 56. In addition, zone 58 also comprises an elongated slot or channel 60 formed along one wall of zone 58, providing the release position for each radially extending fin 35 of each tumbler sleeve 33. As is fully detailed herein, when each locking fin of each tumbler sleeve 33 is aligned with release channel 60, shackle 22 is capable of axial movement, thereby enabling shackle 22 to be removed from its locked position or, if desired, inserted into its locked position, or axially advanced into zone 57 of bore 56 of housing 21, to enable the combination to be changed, set or re-set.

The final zone of bore 56 is upper zone 59 which comprises the largest diameter of bore 56. Generally, the diameter of zone 59 is constructed to enable each tumbler sleeve 33 with its radially extending fin 35 to be easily advanced through first portal 68 of zone 59. In this way, assembly of combination section 23 of padlock 20 is easily attained.

In addition, upper zone 59 and its associated first portal zone 68 are constructed for receiving and securely retaining sealing cap 47. In its preferred construction, sealing cap 47 comprises a cylindrical shape formed by outer surface 70 and upper flange 71. Preferably, the diameter of zone 59 is substantially equivalent to the diameter of outer surface 70 of cap 47 in order to require cap 37 to be forced into first portal 68 and zone 59 and, once inserted therein, securely affixed thereto.

In the preferred construction, tumbler sleeves 34 and locking ring 46 are mounted to leg 27 of shackle 22. Then, when dials 34 are mounted in place, the fully assembled leg 27 of shackle 22 is inserted into first portal 68 of bore 56 of housing 21. The assembly is then completed by forcing sealing cap 47 into first portal 68 of zone 59 of bore 56 until the entire outer surface 70 of cap 47 is fully engaged in zone 59 and peripheral flange 71 contacts top surface 50.

With sealing cap 47 securely, integrally fastened to housing 21, tumbler sleeves 34 are protected from interference from environmental debris. Since bore 56 is effectively sealed from the ambient surroundings, the entry of unwanted dirt and/or debris into bore 56 is effectively prevented. As a result, long-term, trouble-free operation of padlock 20 is provided.

In order to assure that each dial 34 is cooperatively associated with a tumbler sleeve 33 and is rotatable about leg 27 of shackle 22 along with its associated tumbler sleeve, combination controlled locking section 23 of housing 21 incorporates four separate and independent dial receiving zones 61. Each dial receiving zone 61 is formed in juxtaposed spaced aligned parallel relationship with each other, while also being cooperatively associated with zone 58 of central bore 56 and elongated release channel 60. In addition, each dial receiving zone 61 is defined by an upper surface 62 and a lower surface 63 which are parallel to each other. If desired, each dial receiving zone 61 may be cooperatively associated with a spring plate as detailed above. However, if desired, this component may be eliminated.

Whenever a user wishes to set or change the particular combination for operating combination controlled locking section 23 of dual-mode padlock 20, the user is able to quickly and easily alter the particular combination as desired. In order to achieve this change, the user opens padlock 20, using the known combination, and then accurately pivots shackle 22 about the axis of leg 27. Thereafter, by longitudinally advancing leg 27 downwardly into elongated bore 56 of housing 21, fins 35 of tumblers 33 are all disengaged from slots 40 of dials 34.

Once dials 34 are all disengaged from tumblers 33, dials 34 can be arcuately rotated into any desired position. By individually rotating each dial 34 into a particular desired position, a unique or personalized code or sequence is created. Once each dial has been placed into the precisely desired position or alignment, shackle 22 is axially moved upwardly, brining the locking fins 35 of each tumbler 33 into engagement in one slot 40 of one dial 34. Once these steps have been completed, the precisely desired new combination or code is established.

In addition to enabling padlock 20 to be opened by employing combination controlled locking section 23 of housing 21, this embodiment of dual mode padlock 20 of the present invention also incorporates key controlled locking section 24 formed as a part of housing 21 for enabling padlock 20 to be unlocked in a separate and independent alternate manner. By referring to FIGS. 20–26, along with the following detailed discussion, the construction and operation of this key controlled locking and unlocking mode of padlock 20 can best be understood.

In the preferred construction of this embodiment of the present invention, key controlled locking section 24 of housing 21 incorporates elongated bore 110 extending from top surface 50 through to bottom surface 51. As depicted, elongated bore 110 extends substantially parallel to elongated bore 56 formed in combination controlled locking section 23. In addition, in order to provide the desired key controlled arcuate pivoting movement of locking collar 29, for enabling shackle 22 to be securely locked and released, when desired, key controlled locking section 24 incorporates cooperating cylinders 111 and 112.

Cylinders 111 and 112 are each rotationally journalled in elongated bore 110 and are mounted in controlled engagement with each other. If desired, a single elongated cylinder may be employed. However, it has been found for ease of construction, the use of two separate cylinders is preferred. In order to assure that cylinders 111 and 112 are arcuately pivoted simultaneously, effectively functioning as a single elongated cylinder, cylinder 111 incorporates channel 113 formed in the bottom surface thereof, while cylinder 112 incorporates an upstanding flange or ridge 114 formed in its top section. By lockingly engaging flange/ridge 114 in channel 113, cylinders 111 and 112 are arcuately pivoted simultaneously.

In addition, cylinder 112 preferably incorporates axial slotted aperture 86 formed therein which cooperates with pin 85 mounted through housing 21 for extending into aperture 86. In this way, axial movement of cylinders 111 and 112 is prevented, while assuring free pivotal movement therein.

As discussed above, key controlled locking section 24 incorporates locking collar 29 which is constructed for controlled engagement with terminating end 26 of short leg 25 of shackle 22. In the preferred construction of this embodiment, locking collar 29 comprises a substantially circular shaped member incorporating support base 102 on which upstanding, generally U-shaped wall portion 103 is formed. By constructing wall portion 103 in a substantially U-shape, portal or open zone 101 is formed between the terminating ends of wall portion 103.

In the preferred construction of this embodiment of the present invention, locking collar 29 is securely mounted in elongated bore 110 directly adjacent top surface 50 of housing 21. Preferably, locking collar 29 is press-fitted or frictionally engaged in bore 110 in order to assure movement-free affixation of locking collar 29 with housing 21. In addition, as shown in FIGS. 20 and 23–26, portal/open zone 101 of locking collar 29 is positioned in alignment with cutout zone 115 formed in housing 21 for cooperating with locking collar 29. In this way, a pathway is established for the passage of short leg 25 of shackle 22 when key controlled section 24 of padlock 20 is in the open position, as is detailed below.

In order to provide the desired locked, captured engagement of short leg 25 of shackle 22 with locking collar 29, as well as enable shackle 22 to be released from locking collar 29, when desired, this embodiment of padlock 20 incorporates movable plate member 100, which is constructed for co-operating with locking collar 29, portal/open zone 101, and cutout zone 115. As fully detailed below, plate member 100 is constructed for being vertically movable relative to locking collar 29, for effectively opening and closing portal/open zone 101 and cutout zone 115. In this way, the arcuate pivoting movement of shackle 22 about the axis of its long leg 27 is completely controlled by locking section 24 of padlock 20.

As shown in FIGS. 20–26, in this embodiment of the present invention, cylinders 111 and 112 are coaxially mounted in elongated bore 110 for rotational movement therein about the central axes of cylinders 111 and 112. As fully detailed herein, rotational movement of cylinders 111 and 112 is attainable only when the designated key 89 is inserted in the key receiving slot formed in cylinder 112. Furthermore, as discussed above, the key-controlled rotational movement of cylinder 112 causes cylinder 111 to rotate simultaneously therewith, due to the secure interengagement of cylinders 111 and 112.

In its preferred construction, cylinder 111 is constructed with a substantially circular shaped base portion 118, with channel 113 formed in one end thereof. On the opposed end, axially extending support pin 119 is formed, with circular shaped plate 120 mounted on the opposed end of pin 119. Finally, the construction of cylinder 111 is completed by positioning upstanding, axially extending, substantially cylindrical post 121 on the upper surface of plate 120, with post 121 comprising a substantially flat, top surface 122 and a curved outer surface 123. In addition, as depicted, post 121 is constructed with an overall diameter less than the diameter of plate 120 and base 118.

Post 121 also incorporates cam slot 124 formed in curved, outer surface 123, with cam slot 124 extending at a sloping angle relative to substantially flat top surface 122. In the preferred construction, the slope angle employed for cam slot 124 ranges between about 30° and 60°. Furthermore, in its preferred embodiment, sloping cam slot 124 terminates directly adjacent top surface 122, in a substantially horizontally extending section 125, with section 125 extending substantially parallel to top surface 122.

In completing the preferred construction of this embodiment of the present invention, movable plate member 100 is mounted in elongated bore 110 directly adjacent top surface 50 of housing 21 in co-operating relationship with locking collar 29, while also being movably controlled by the rotation of cylinder 111. Preferably, movable plate member 100 comprises wall member 104, having an inside surface 105 and outside surface 106, with wall member 104 being constructed with an arcuately curved configuration that is dimensioned for insertion in co-operating sliding engagement with elongated bore 110. In this regard, the overall thickness of wall member 104 is constructed for nested, sliding engagement between outer surface 123 of post 121 and the inside surface of bore 110.

In addition, plate member 100 incorporates arcuately curved blocking segment 107 which is mounted to inside surface 106 of wall member 104. As depicted, blocking segment 107 is mounted near the upper edge of wall member 104, with a portion of blocking segment 104 extending beyond the terminating upper edge of wall member 104. Finally, the construction of movable plate member 100 is completed by forming cam follower pin 108 on inside surface 105 of wall member 104, positioned near the bottom edge thereof, with pin 108 radially extending inwardly from wall member 104.

In the preferred construction, blocking segment 107 is dimensioned with an overall, arcuately curved width which is substantially equivalent to the arcuate curved width of portal/open zone 101 of locking collar 29. In this way, as shown in FIG. 25, when movable plate member 100 is in its first, upper, raised position, blocking segment 107 effectively closes upstanding, U-shaped wall portion 103, sealing portal/open zone 101 and effectively locking short leg 25 of shackles 22 in locking collar 29 by peripheral, surrounding engagement thereof.

In addition, as shown in FIG. 26, whenever plate member 100 is moved into its second, lowered position, blocking segment 107 is moved out of closing alignment with U-shaped wall portion 103 of locking collar 29, effectively opening portal/open zone 101 thereof for enabling short leg 25 of shackle 22 to move through portal/open zone 101 and cutout zone 115, enabling shackle 22 to be arcuately pivoted and released from locked engagement with housing 21. In this way, the desired secure locked engagement of shackle 22 with housing 21 is achieved, along with the quick and easy release of shackle 22 from housing 21, by employing key controlled section 24 of padlock 20.

In order to achieve the desired vertical movement of plate member 100 for controlling the locking engagement and/or release of short leg 25 of shackle 22, plate member 100 is positioned in elongated bore 111 with the movement thereof completely controlled by the rotational movement of cylinder 111. In attaining this construction, outside surface 106 of wall member 104 is positioned in sliding engagement with the inside surface of bore 110, while inside surface 105 of wall member 104 is positioned in sliding engagement with outside surface 123 of post 121. In addition, radially extending, follower pin 108 is mounted in cam slot 124 and/or slot 125 for controlled movement therein.

Figure 25:
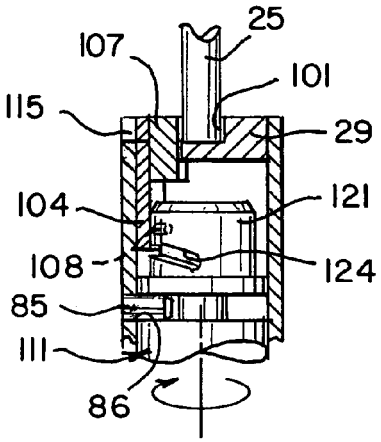
FIG. 25 is a cross-sectional side elevation view, partially broken away, taken along line 25—25 of FIG. 23 and depicting this embodiment of the dual mode padlock in its locked configuration.
Figure 24:
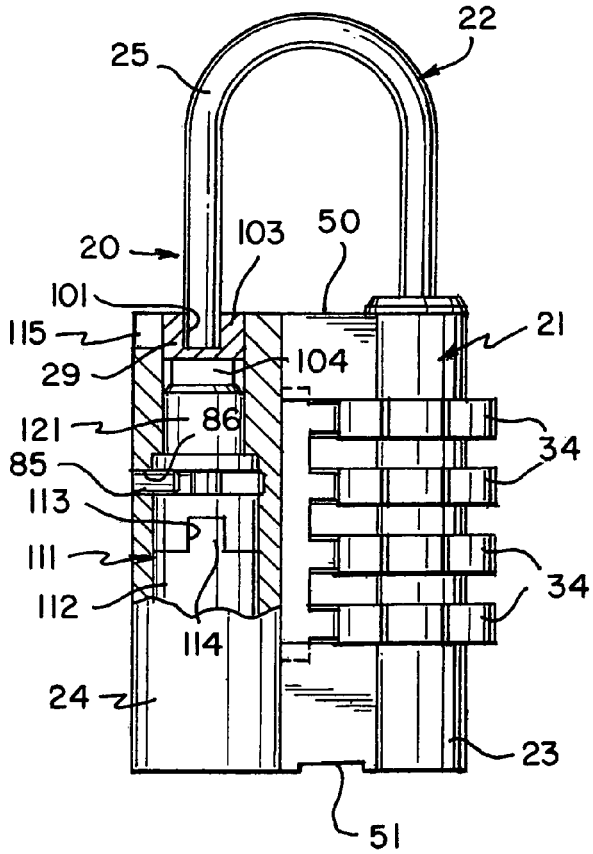
FIG. 24 is a side elevation view, partially broken away, of the dual mode padlock of FIG. 23.

As best seen in FIGS. 25 and 26, the rotational movement of cylinders 111 and 112 causes plate member 100 to vertically move between its first positioned and its second position. As previously discussed, cylinders 111 and 112 are capable of only rotational movement about their central axes. Vertical movement of cylinders 111 and 112 is prevented. Consequently, when the designated key is inserted into cylinder 112 for enabling cylinder 112 to be rotated about its central axis, cylinder 111 simultaneously rotates therewith. This rotational movement causes follower pin 108 to first move from extension slot 125 into sloping cam slot 124 and, thereafter, to move through sloping slot 124.

Thereafter, once follower pin 108 is in upper portion of sloping cam slot 124, the continued rotation of the cylinder 111 forces follower pin 108 to move downwardly through cam slot 124 as cylinder 111 continues to rotate. The downward movement of pin 108 causes wall member 104 and blocking segment 107 to move vertically downwardly in elongated bore 110, effectively removing blocking segment 107 from cooperating engagement with locking collar 29. In this way, short leg 25 of shackle 22 is released and, once plate member 100 has been moved into its second position, shackle 22 is capable of pivoting out of engagement with locking collar 29, thereby enabling padlock 20 to be released. In this way, an alternate preferred embodiment for constructing key controlled locking section 24 is attained in a manner which provides secure locked engagement of short leg 25 of shackle 22, while also enabling the quick and easy release of short leg 25 whenever a user has an authorized key.

As discussed above, cylinder 112 incorporates key receiving slot 88 formed in the base thereof which is constructed for cooperating controlled relationship with key 89. Furthermore, cylinder 112 incorporates a plurality of spring biased tumblers 87 which are constructed for cooperating with cut-out zones formed on key 89.

In this construction, which is conventional in key controlled locking, tumblers 87 prevent the arcuate movement of cylinder 112 unless all tumblers 87 are positioned in a precise, predetermined alignment and/or arrangement. When in the desired aligned position, cylinder 112 is capable of being arcuately rotated.

In addition, in order to achieve the precisely desired aligned position for enabling cylinder 112 to be arcuately rotated, key 89 is employed for axially positioning each tumbler 87 in the precisely desired, predetermined position. In addition, key 89 provides the necessary leverage for enabling cylinder 112 to be arcuately pivoted.

Once key 89 is inserted into slot 88 of cylinder 112, tumblers 87 are aligned in the precisely desired predetermined position, enabling cylinder 112 to be arcuately rotated. In addition, since flange 114 of cylinder 112 is engaged within channel or slot 113 of cylinder 112, the arcuate pivoting movement of cylinder 112 simultaneously causes cylinder 111 to arcuately pivot therewith. Furthermore, with plate member 100 movably controlled by the rotation of cylinder 111, the arcuate pivoting movement of cylinder 111 causes plate member 100 to move between its two alternate positions, either locking shackle 22 or releasing shackle 22.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

I claim:

1. A padlock constructed for providing two separate and independent locking means in a single, integrated construction, with a first locking assembly being controlled by a combination and a second locking assembly being key controlled, said padlock comprising:

A. a housing incorporating
  1. a first elongated bore, and a second elongated bore,
  2. a plurality of dial receiving zones formed in the housing in association with the first elongated bore, and
  3. an elongated release channel formed in the first elongated bore and axially extending therewith, said elongated release channel defining a zone for enabling the opening of the combination controlled lock assembly;

B. locking means in the form of a shackle comprising a generally J-shape, incorporating
  1. a short leg having a terminating end constructed for cooperative locking and unlocking interengagement with a shackle engaging collar mounted in the housing, and
  2. a long leg cooperatively mounted in the first elongated bore of the housing for axial movement and pivoting movement relative thereto;

C. a plurality of tumbler sleeves, each of said tumbler sleeves
  1. rotationally mounted to the long leg of the shackle for rotational movement about the central axis thereof, and
  2. incorporating a radially extending fin formed on the outside surface thereof and constructed for cooperative association with the elongated release channel for preventing axial movement of the long leg of the shackle as well as enabling axial movement thereof when each of said radial fins are positioned in the elongated release channel;

D. a plurality of dials each of said dials
  1. mounted in a dial receiving zone of the housing, and
  2. peripherally surrounding a tumbler sleeve for cooperating therewith, thereby establishing the combination controlled assembly of the padlock; and E. a key controlled lock assembly mounted in the second elongated bore of the housing and constructed for being responsive to a designated key member for enabling movement between a first position, wherein the shackle is in locked engagement, and a second position, wherein the shackle is unlocked and movable, said lock assembly comprising:
  1. cylinder assembly
    a. mounted in the second elongated bore for controlled rotational movement therein,
    b. incorporating a key receiving slot cooperatively associated with a plurality of tumblers for preventing the rotational movement of said cylinder whenever the designated key member is not present and enabling rotational movement of the cylinder in response to the presence of the designated key member, and
    c. comprising a first, substantially cylindrically shaped member and a second, substantially cylindrically shaped member, both of which are coaxially mounted in co-operating, interengagement with each other, said second substantially cylindrically shaped member incorporating a cam slot formed therein.
  2. a shackle engaging collar cooperatively associated with the terminating end of the short leg of the shackle for peripherally surrounding the terminating end of the short leg of the shackle in its substantial entirety, with one portion of said collar forming an open zone for enabling the arcuate pivoting movement of the shackle about the central axis of the long leg thereof in a single direction, and
  3. a plate member a. cooperatively associated with the open zone of the shackle engaging collar and being vertically movable relative thereto for blocking the open zone when the plate member is in a first position and establishing the open zone when said plate members is in a second position, and b. controllably engaged with the second, substantially cylindrically shaped member for being vertically movable in response to the rotational movement of said second cylindrically shaped member, and incorporating a radially extending follower pin mounted in said cam slot of the second cylindrically shaped member for effectively causing said plate member to move vertically in response to the rotational movement of said second cylindrical member, whereby said plate member is controllably moved between its first, blocking position and its second, open position, thereby enabling said plate member to effectively block the pivoting movement of the shackle when in its first position and enabling the pivoting movement of the shackle when in its second position.

2. The padlock defined in claim 1, wherein the first substantially cylindrically shaped member is further defined as incorporating a key receiving slot formed in a first end thereof and an upstanding ridge formed on a second end thereof.

3. The padlock defined in claim 2, wherein the second, substantially cylindrically shaped member is further defined as comprising a slot formed in a first end thereof, said slot being positioned for co-operating, interengaged relationship with the upstanding ridge of the first cylindrically shaped member, whereby rotational movement of the first cylindrically shape member causes rotational movement of the second cylindrically shaped member.

4. The padlock defined in claim 3, wherein the shackle engaging collar is further defined as being integrally formed on a second end of the second cylindrically shaped member for being arcuately pivotable with the movement of the second cylindrically shaped member about it central axis, effectively forming a movable portal for the short leg of the shackle, whereby arcuate pivoting movement of the shackle is blocked when the open zone of the collar is in a first blocking position and enabling arcuate pivoting movement of the shackle when the open zone of the collar is in a second position aligned with the travel path of the shackle leg.

5. The padlock defined in claim 1, wherein said cam slot is further defined as comprising a first section having as sloped angle relative to the central axis of the second cylindrically shaped member and a second section formed at the upper end of the first section and extending substantially perpendicularly to the central axis of the second cylindrically shaped member.

6. The padlock defined in claim 5, wherein the sloped angle of the first section of the cam slot ranges between about 30° and 60°.

7. The padlock defined in claim 1, wherein said plate member is further defined as comprising an arcuately curved wall portion mounted in the second elongated bore between the inside wall of the second elongated bore and the outer surface of the second cylindrically shaped member for vertical movement therebetween.

8. The padlock defined in claim 7, wherein said plate member further comprises a blocking portion affixed to the inside surface of the wall portion and positioned for cooperating movement relative to the open zone formed in the U-shaped shackle engaged collar.

9. The padlock defined in claim 1, wherein said first elongated bore comprises three separate and distinct zones, formed by a lowermost zone, a central zone and an uppermost zone, with each zone comprising different diameters with the lowermost zone comprising the smallest diameter and the uppermost zone comprising the largest diameter.

10. The padlock defined in claim 9, wherein the dials are each further defined as comprising a generally cylindrical shape have a plurality of indicia bearing panels on an outer surface thereof for establishing readily identifiable indicia which define elements usable as the combination for defining the release mode of the first locking means.

11. The padlock defined in claim 10, wherein each of said dials is further defined as comprising a slot formed on the outer surface thereof between each adjacent indicia bearing panel.

12. The padlock defined in claim 11, wherein said housing is further defined as comprising a cavity directly adjacent each dial receiving zone and the first locking means is further defined as comprising a spring and pin member mounted in each cavity for cooperating interengagement with each dial, providing a indicator for designating the position of the rotating dial and indicating when each panel is in a desired orientation for designating an element of the combination.

13. The padlock defined in claim 12, wherein each of said tumbler sleeves is further defined as being mounted to the long leg of the shackle for rotational movement about the axis of the shackle while being essentially incapable of translational movement along the axis of the long leg of the shackle.

14. A padlock constructed for providing two separate and independent locking means in a single, integrated construction, said padlock comprising:

A. a housing incorporating a first locking section constructed for being controlled by a combination and a second locking section constructed for being controlled by a key;

B. locking means in the form of a shackle comprising a first leg, a second leg, and an intermediate arcuately curved portion, C. a key controlled lock assembly mounted in the locking section of the housing and constructed for being responsive to a designated key member for enabling movement between a first position, wherein the shackle is in locked engagement, and a second position, wherein the shackle is unlocked and movable, said lock assembly comprising:

1. a cylinder assembly
   a. mounted in the housing for controlled rotational movement therein,
   b. incorporating a key receiving slot cooperatively associated with a plurality of tumblers for preventing the rotational movement of said cylinder whenever the designated key member is not present and enabling rotational movement of the cylinder in response to the presence of the designated key member, and
   c. comprising a first, substantially cylindrically shaped member and a second, substantially cylindrically shaped member, both of which are coaxially mounted in co-operating, interengagement with each other, said second substantially cylindrically shaped member incorporating a cam slot formed therein,
2. a shackle engaging zone formed in the housing and cooperatively associated with a terminating end of the first edge of the shackle for peripherally surrounding the terminating end of the first leg of the shackle in its substantial entirety, with one portion of said zone comprising an open area for enabling the arcuate pivoting movement of the shackle about the central axis of its second leg in a single direction, and
3. a plate member
   a. cooperatively associated with the open area of the shackle engaging zone and being vertically movable relative thereto for blocking the open area when the plate member is in a first position and establishing the open area when said plate members is in a second position, and b. controllably engaged with the second, substantially cylindrically shaped member for being vertically movable in response to the rotational movement of said second cylindrically shaped member, and incorporating a radially extending follower pin mounted in said cam slot of the second cylindrically shaped member for effectively causing said plate member to move vertically in response to the rotational movement of said second cylindrical member, whereby said plate member is controllably moved between its first, blocking position and its second, open position, thereby enabling said plate member to effectively block the pivoting movement of the shackle when in its first position and enabling the pivoting movement of the shackle when in its second position.

* * * * *